US007281452B2

(12) United States Patent
Chang

(10) Patent No.: US 7,281,452 B2
(45) Date of Patent: Oct. 16, 2007

(54) WRENCH HAVING A RATCHET HEAD ABLE TO VERTICALLY AND HORIZONTALLY ROTATE FOR 360°

(76) Inventor: Pi-Hsia Chang, P.O. Box 697, Feng-Yuan City, Taichung Hsien (TW) 420

( * ) Notice: Subject to any disclaimer, the term of this patent is extended or adjusted under 35 U.S.C. 154(b) by 16 days.

(21) Appl. No.: 10/769,773

(22) Filed: Feb. 3, 2004

(65) Prior Publication Data

US 2005/0166718 A1 Aug. 4, 2005

(51) Int. Cl.
*B25B 13/46* (2006.01)
*B25B 23/16* (2006.01)

(52) U.S. Cl. ..... 81/60; 81/177.2; 81/177.8

(58) Field of Classification Search ..... 81/177.7, 81/177.8, 177.9, 177.75, 60
See application file for complete search history.

(56) References Cited

U.S. PATENT DOCUMENTS 1,292,285 A * 1/1919 Fairchild ..... 81/60
1,453,607 A * 5/1923 Saucier ..... 81/60
2,977,824 A * 4/1961 Rueb ..... 81/177.8
4,409,866 A * 10/1983 McBride ..... 81/177.2
5,522,287 A * 6/1996 Chiang ..... 81/60

* cited by examiner

*Primary Examiner*—Debra S Meislin

(57) ABSTRACT

A wrench having a ratchet head able to vertically and horizontally rotate for 360° includes a tang having a longitudinal slit of predetermined length in the center and a pair of symmetrical prongs integrated with a front end thereof for rotatably engaging with a drum-shaped ratchet head which has a solid rectangular driver on underside and a hexagonal box driver on the top, a handle slidably sleeved on the tang having a small upper through hole for disposing a pressed button and a large lower through hole in an underside a bolt inserted through the lower through hole, the slit and screwed with the press button, a positioning cap fixed within the large lower through hole and biased by a spring therebetween engageable within one of the retaining grooves under the tang.

6 Claims, 9 Drawing Sheets

WRENCH HAVING A RATCHET HEAD ABLE TO VERTICALLY AND HORIZONTALLY ROTATE FOR 360°

BACKGROUND OF THE INVENTION

The present invention relates to wrenches and more particularly to a wrench having a ratchet head able to vertically and horizontally rotate for 360° and a lengthily adjustable handle.

Wrench is of a tool to use often, prior art wrenches including solid head type, ratchet head type or the left, right rotations and stopping three stepped type. However, the users feel unsatisfied to use the wrench with horizontal rotation ratchet head. That's why the wrench with a vertical rotation ratchet is to rise because of the users demand. But this type of vertical rotation ratchet can only rotate a certain angle and can not rotate for 360°. So that the users can not use it in a defiladed space. FIG. 11 shows a wrench having a ratchet head 30 pivoted to a pair of prongs 31 on the front end of a handle 32. The ratchet head 30 can only vertically rotate on the prongs for a limited angle and has only a driver 33 on one side to drive the box types driving means, which is not convenient and could not present a multifunctional situation. Further, the handle of the prior art wrench including the short type, the middle type and the long type. Therefore, the users must prepare the wrenches of different length of handles that causes inconvenience and cost more.

SUMMARY OF THE PRESENT INVENTION

The present invention has a main object to provide a wrench having a ratchet head which is able to vertically and horizontally rotate for 360° in order to give a nimble operation to the users.

Another object of the present invention is to provide a wrench having a ratchet head in which the handle is lengthily adjustable to accommodate the operational requirement and to reduce the volume of the wrench.

Further object of the present invention is to provide a wrench having a ratchet head which has a solid rectangular driver and a hexagon box driver to facilitate the operation of the users.

Accordingly, the wrench of the present invention comprises generally a tang adjustably inserted into a handle. The tang has a longitudinal slit and a front end thereof integrated with a pair prongs for pivotally engaging within a ratchet head which has a solid rectangular driver and a hexagonal box driver respectively positioned on upper and lower sides. The feature is that the ratchet head can be able to vertically rotate on the prongs for 360° and the drivers on the ratchet head can be able to rotate horizontally for 360° when drive a working object so as to provide a convenient and a nimble operation of the wrench to the users.

The present invention will become more fully understood by reference to the following detailed description thereof when read in conjunction with the attached drawings.

DETAILED DESCRIPTION OF THE PREFERRED EMBODIMENT

Figure 8:
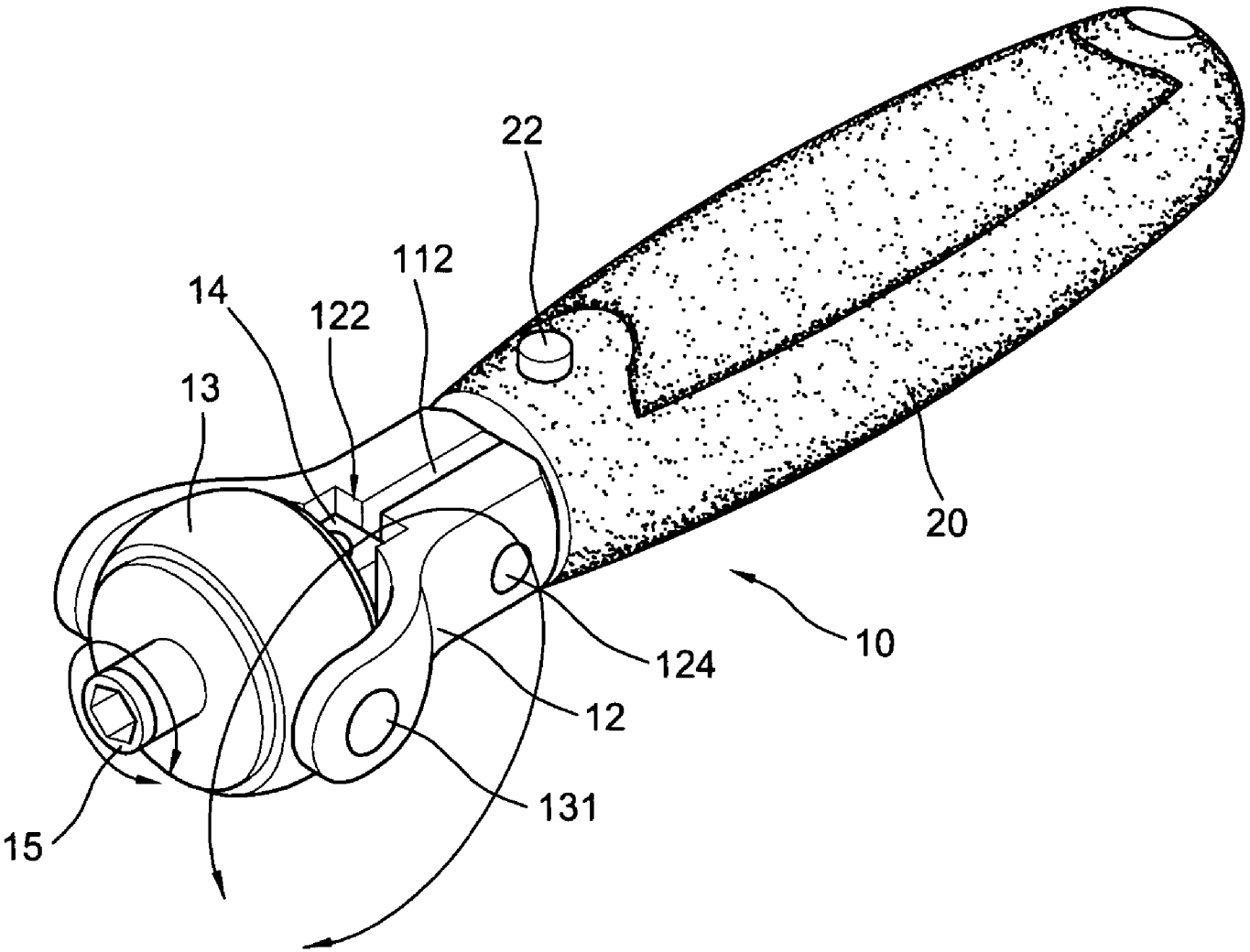
FIG. 8 is a perspective view to show the vertical rotation of the ratchet head.
Figure 9:
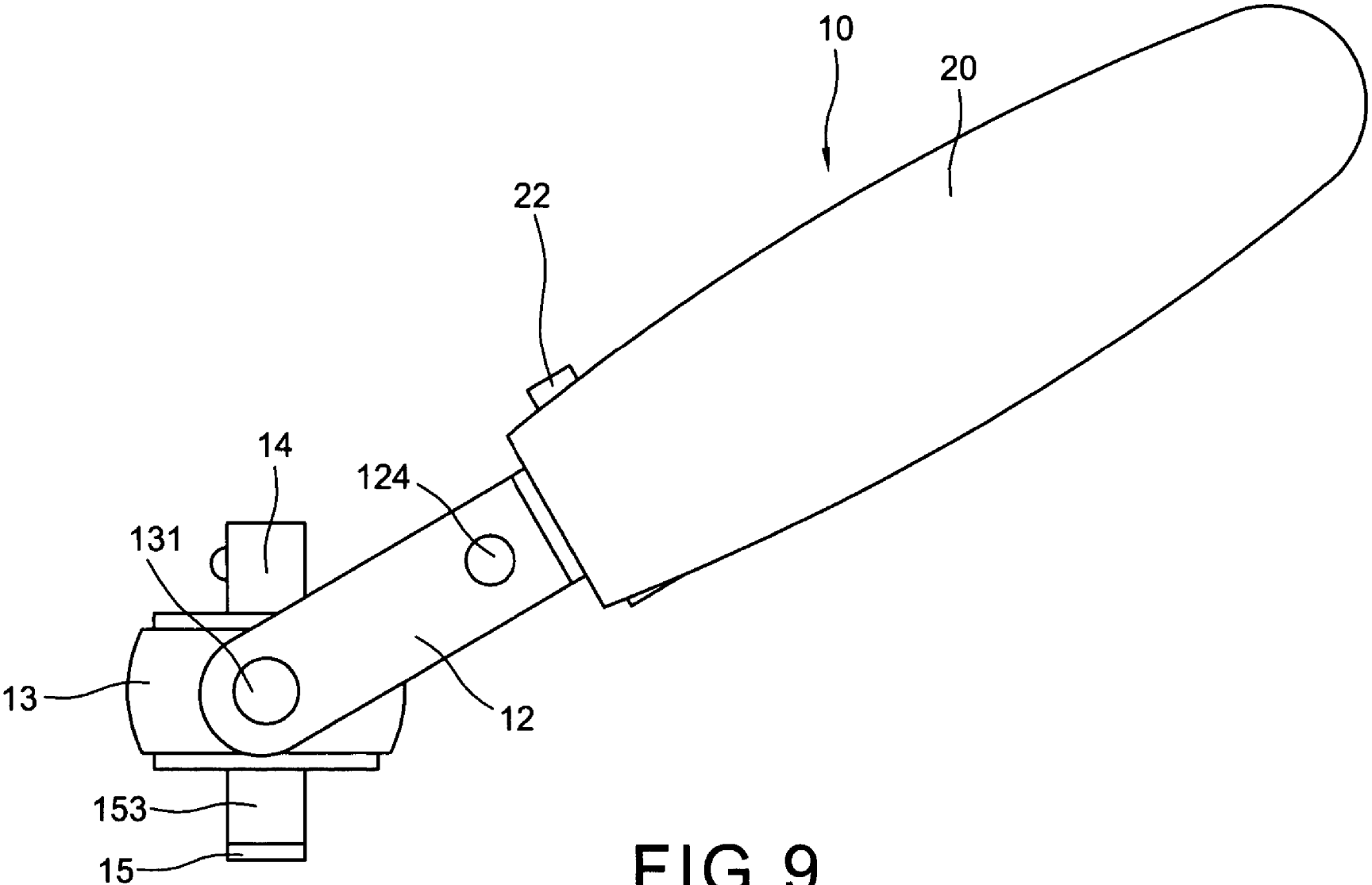
FIG. 9 is a side plane view indicating that the ratchet head is rotated a certain vertical angle.

With reference to FIGS. 1 to 4 of the drawings, the wrench having a ratchet head able to vertically and horizontally rotate for 360° of the present invention comprises a wrench 10 composed of a tang 11 which has a front retaining groove 111 in an underside adjacent front end, a longitudinal slit 112 of predetermined length in the center, a rear retaining groove 113 in an underside adjacent rear end, a pair of pivotal symmetrical arcuate prongs 12 integrated with the front end of the tang 11 and a screw 124 secured through a screw hole 123 each prongs 12 has an axial hole 121 adjacent free end and an indentation 122 in an inner side communicating to the slit 112, a drum-shaped ratchet head 13 having a pair of axial rods 131 on the opposing peripheries pivotally engaged within the axial holes 121 of the prongs 12, a solid rectangular driver 14 on the center of the bottom, a box driver 15 on the center of the top including a hexagonal central bore 151, wherein the box driver 15 may be magnetic to directly attract a working object and having a steel ball 152 in a peripheral through hole and an C-shaped elastic plate 153 wrapped on the outer periphery of the box driver 15 to protect the steel ball 152 and to give the steel ball 152 an elastic displacement force, so that the ratchet head 13 can be able to vertically rotate on the pair of axial holes 121 for 360° (as shown in FIGS. 8 and 9), because the drivers 14 and 15 can be passing through the indentation 122 of the prongs 12 so the drivers 14 and 15 can horizontally rotate for 360° on both lateral directions, when drive a working object (since the inner structure of the ratchet head 13 is of conventional, no repetitious description is required), a handle 20 having a central bore slidably sleeved on the tang 11, an upper through hole 21, a lower through hole 26 in the opposing peripheries, wherein the lower through hole 26 has a diameter larger than that of the upper through hole 21, a press button 22 disposed in the upper through hole 21 having inner threads, a bolt 23 inserted through the lower through hole 26 and the slit 112 of the tang 11 and having outer threads 232 abutting the upper end screwed with the inner threads of the press button 22 and a stop head on lower end engageable within the retaining grooves 111 and 113 of the tang 11 and a positioning cap 25 fixedly engaged within the lower through hole 26 with a spring 24 biased therebetween. on both lateral directions when drive a working object (since the inner structure of the ratchet head 13 is of conventional, no repetitious description is required), a handle 20 having a central bore slidably sleeved on the tang 11, an upper through hole 21, a lower through hole 26 in the opposing peripheries, wherein the lower through hole 26 has a diameter larger than that of the upper through hole 21, a press button 22 disposed in the upper through hole 21 having inner threads, a bolt 23 inserted through the lower through hole 26 and the slit 112 of the tang 11 and having outer threads 232 abutting the upper end screwed with the inner threads of the press button 22 and a stop head on lower end engageable within the retaining grooves 111 and 113 of the tang 11 and a positioning cap 25 fixedly engaged within the lower through hole 26 with a spring 24 biased therebetween.

Figure 1:
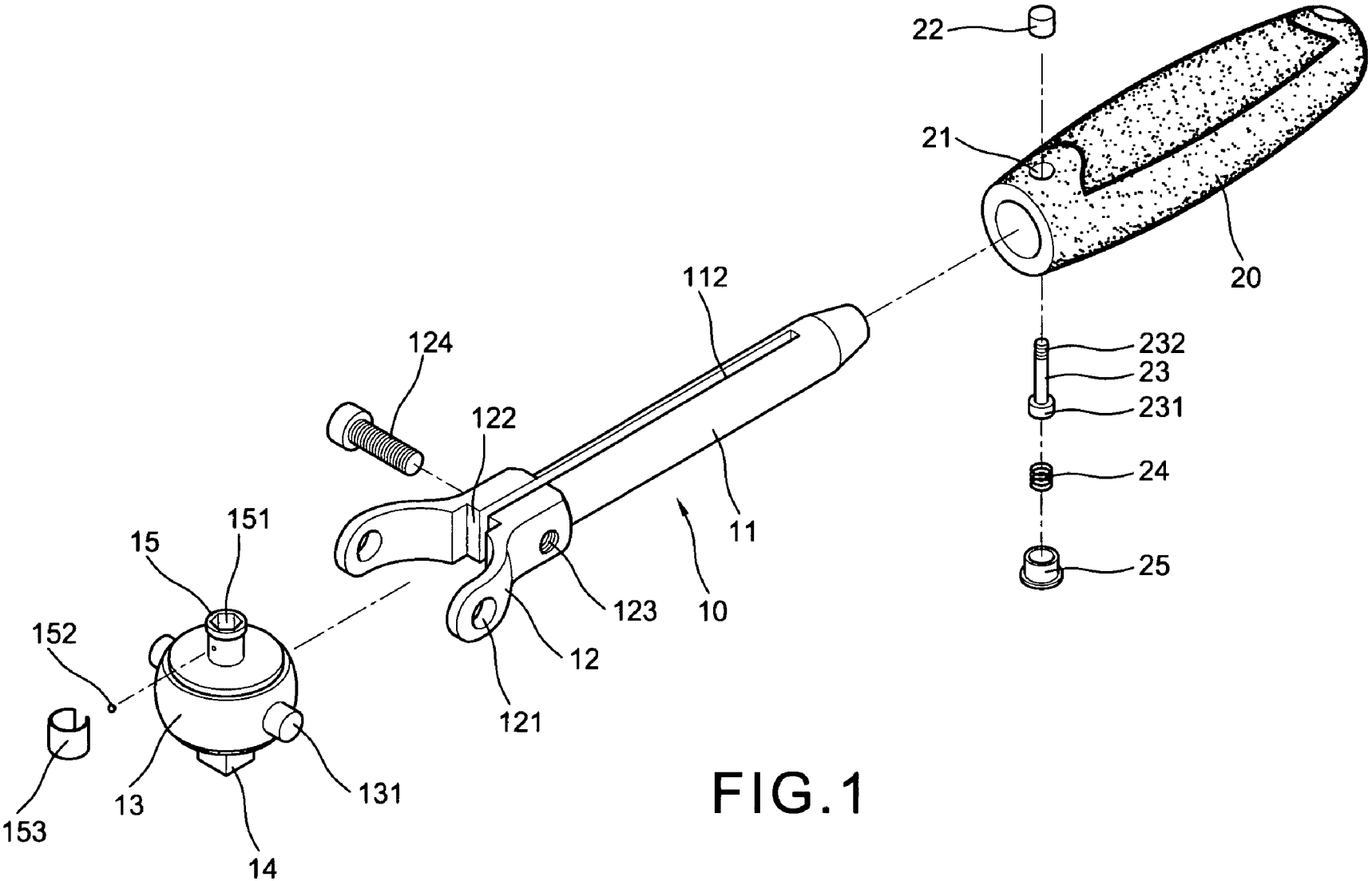
FIG. 1 is an exploded perspective view of a preferred embodiment of the wrench of the present invention.
Figure 2:
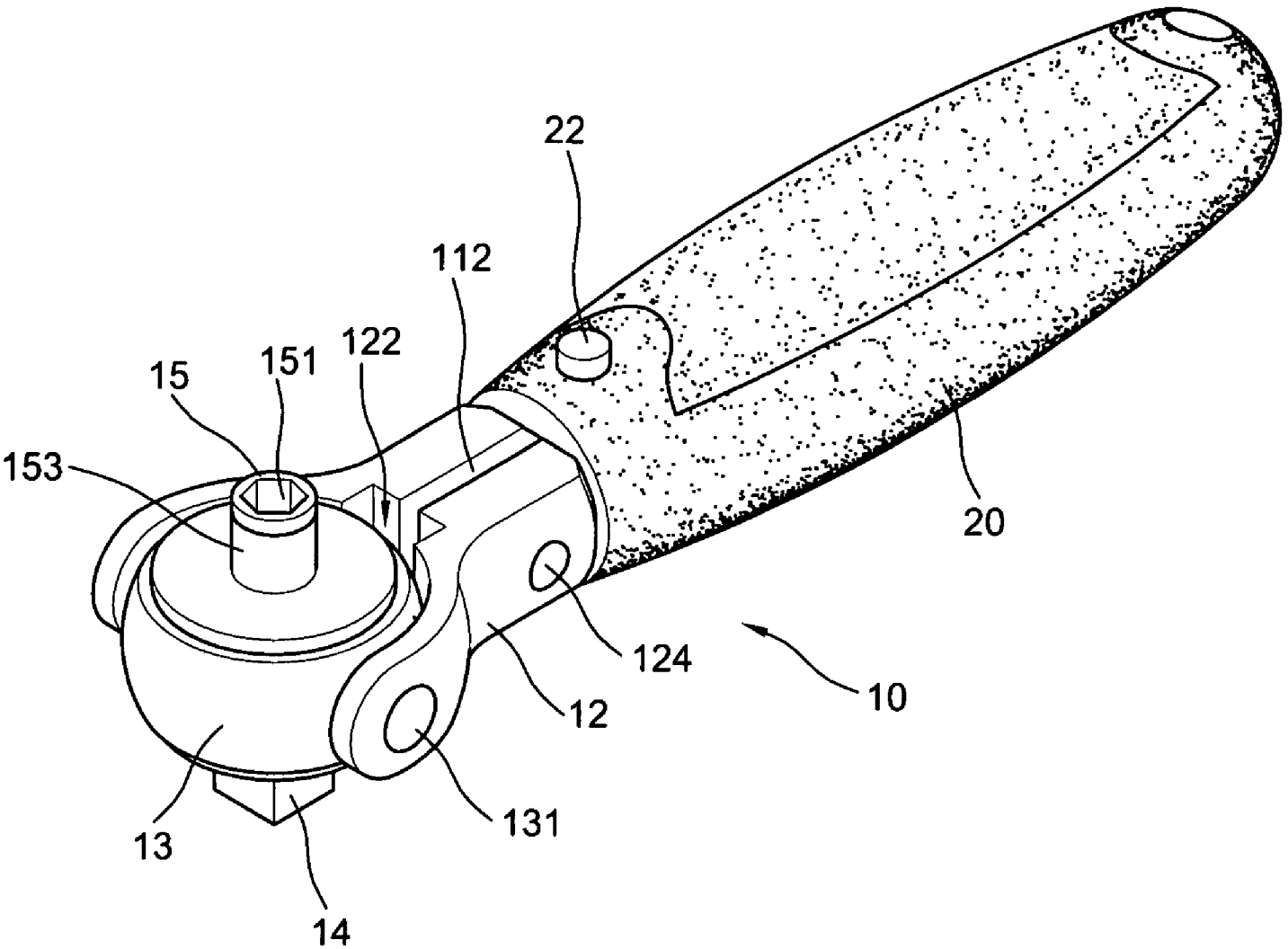
FIG. 2 is a perspective view to show the assembly of the wrench of the present invention.
Figure 3:
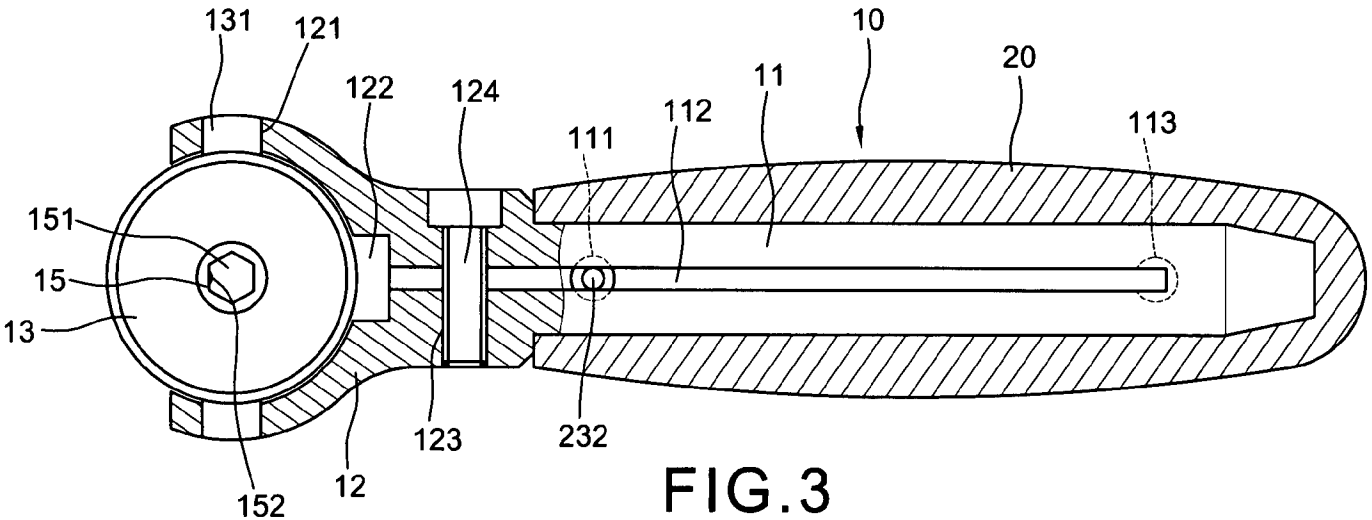
FIG. 3 is a top sectional view of FIG. 2.
Figure 4:
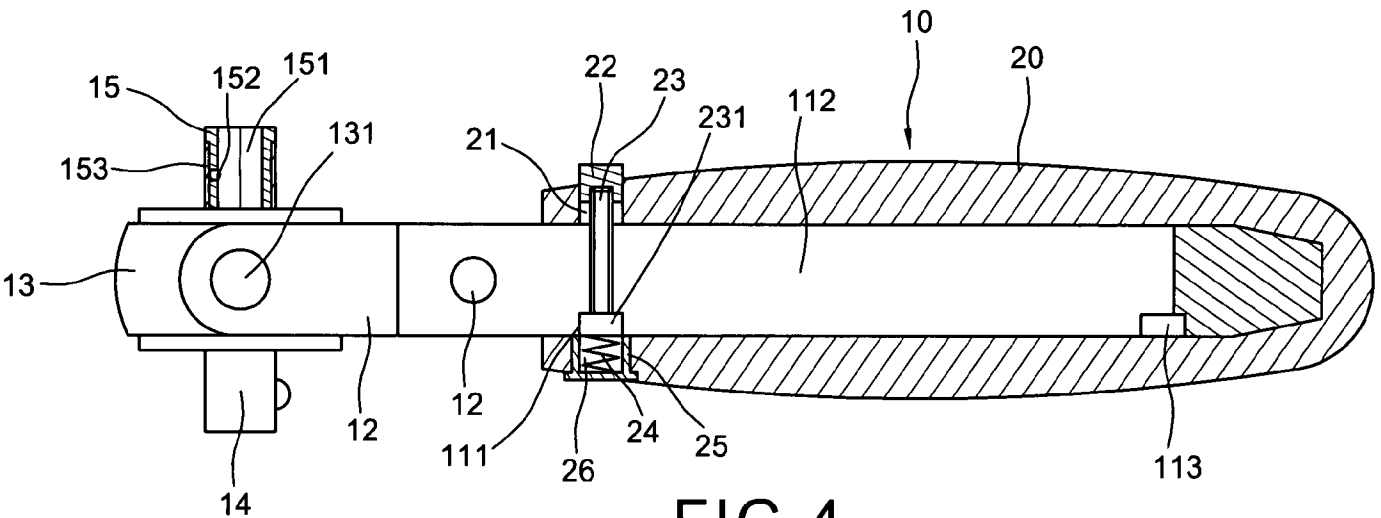
FIG. 4 is a side sectional view of FIG. 2.
Figure 5:
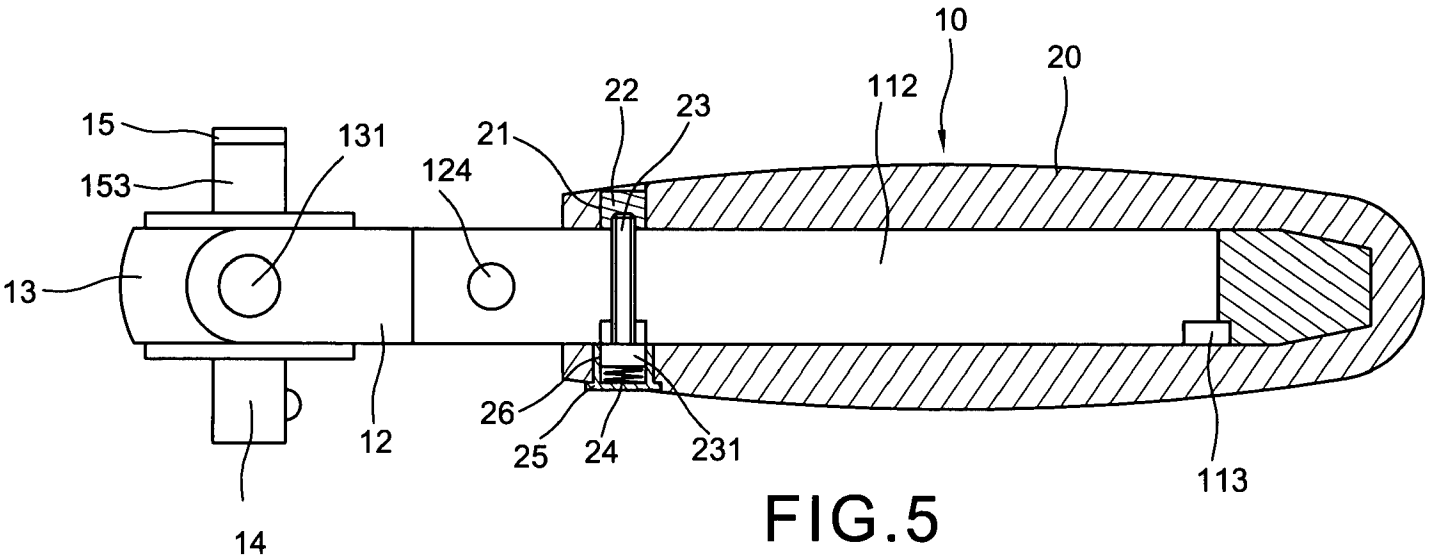
FIG. 5 is a side sectional view indicating that a positioning cap is pressed inward while a press button is squeezed to move outward.
Figure 6:
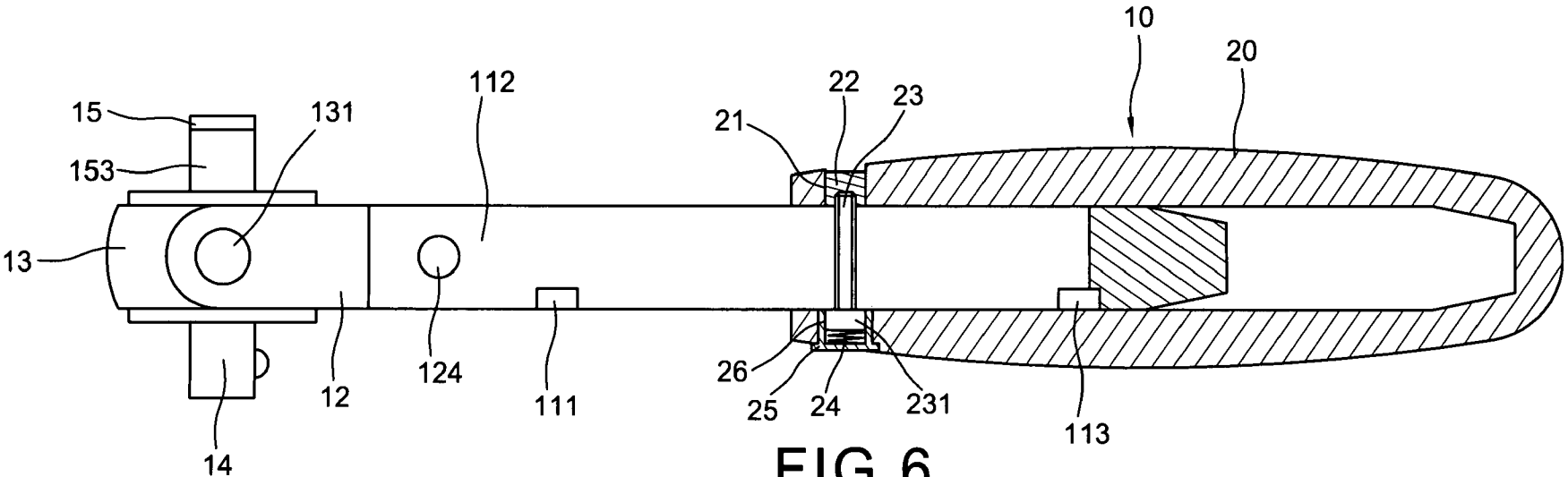
FIG. 6 is a side sectional view indicating that the handle is pulling rearward.
Figure 7:
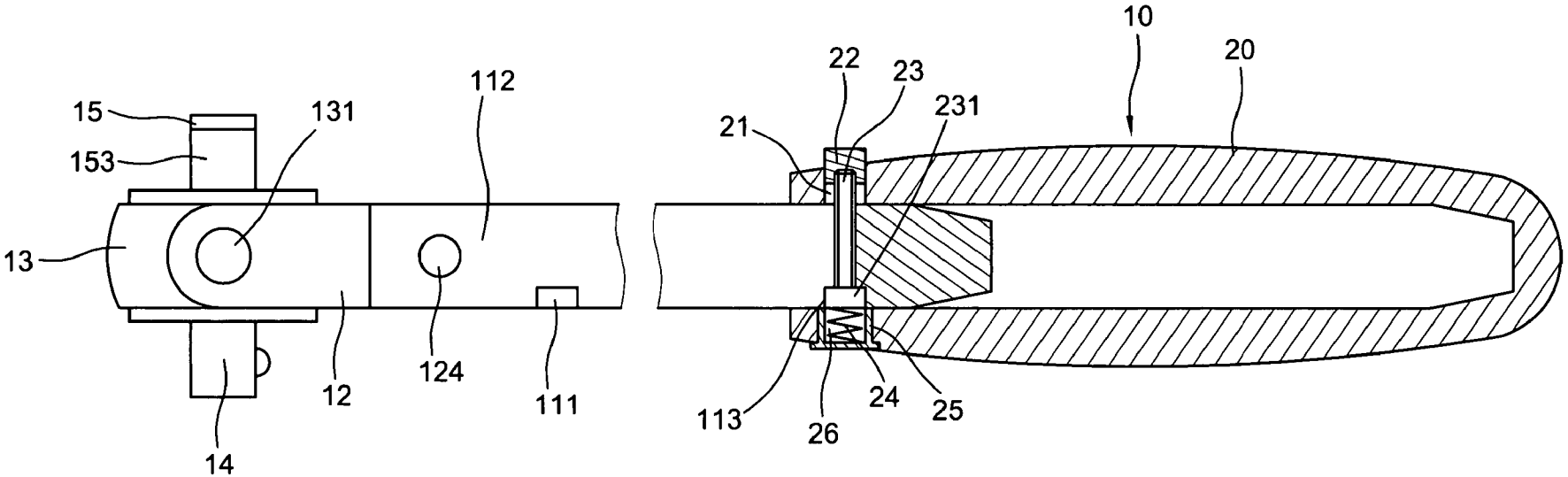
FIG. 7 is a side sectional view indicating that the handle is pulled to a rearmost position while a stop block engages within a rear retaining groove.

Referring to FIGS. 5, 6 and 7 and FIG. 4 again, the press button 22 is normally protrueded out of the upper through hole 21 and the stop head 231 of the bolt 23 is engaged within the front retaining groove 111 of the tang 11 due to the resilience of the spring 24. So that the handle 20 is fixed and the wrench 10 is operable. When presses the press button 22 downward to enter into the upper through hole 21, the stop head 231 of the bolt 23 is forced to disengage with in front retaining groove 111 of the tang 11 and the handle 20 is movable on the tang 11 due to the bolt 23 is slidable within the slit 112 (as shown in FIGS. 5 and 6) and when the handle 20 is pulled to a rearmost position of the tang 11, the stop head 231 of the bolt 23 is automatically engaged within the rear retaining groove 113 of the tang 11 due to the resilience of the spring 24. The wrench 10 is therefore elongated. Note that the handle 20 may be made of rigid plastic material or a metal pipe wrapped by plastic and/or the entire metallic material.

Figure 10:
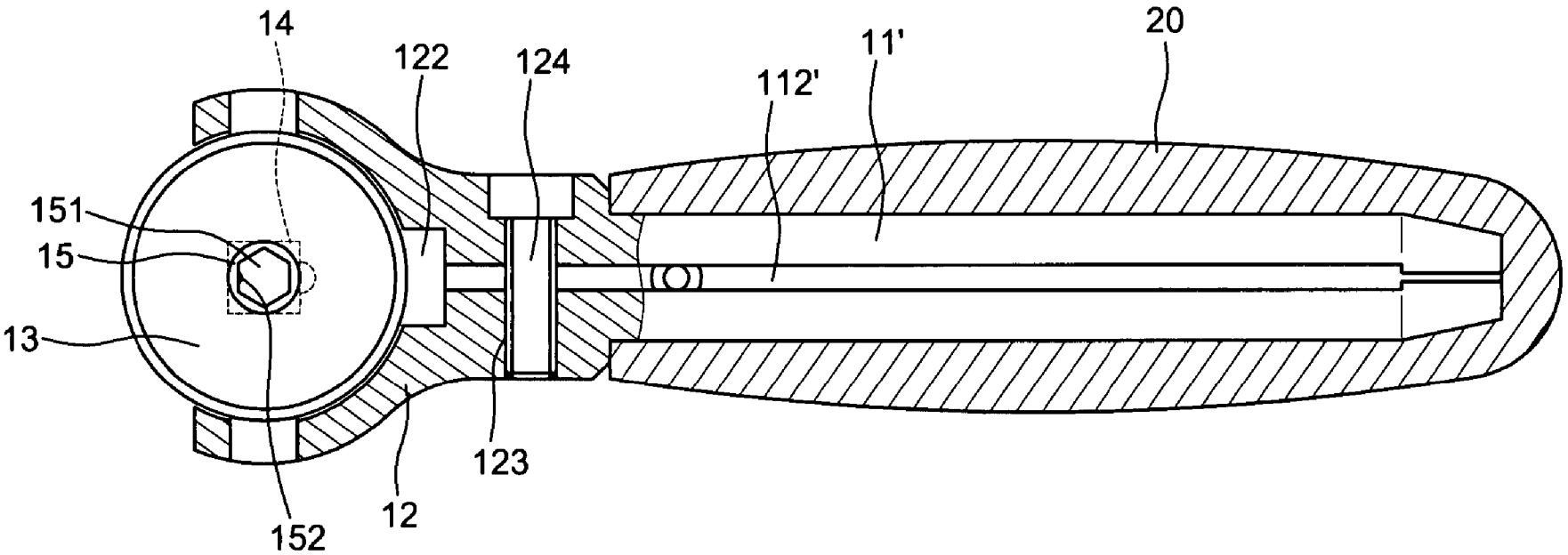
FIG. 10 is a top sectional view to show an alternate embodiment of the wrench of the present invention.
Figure 11:
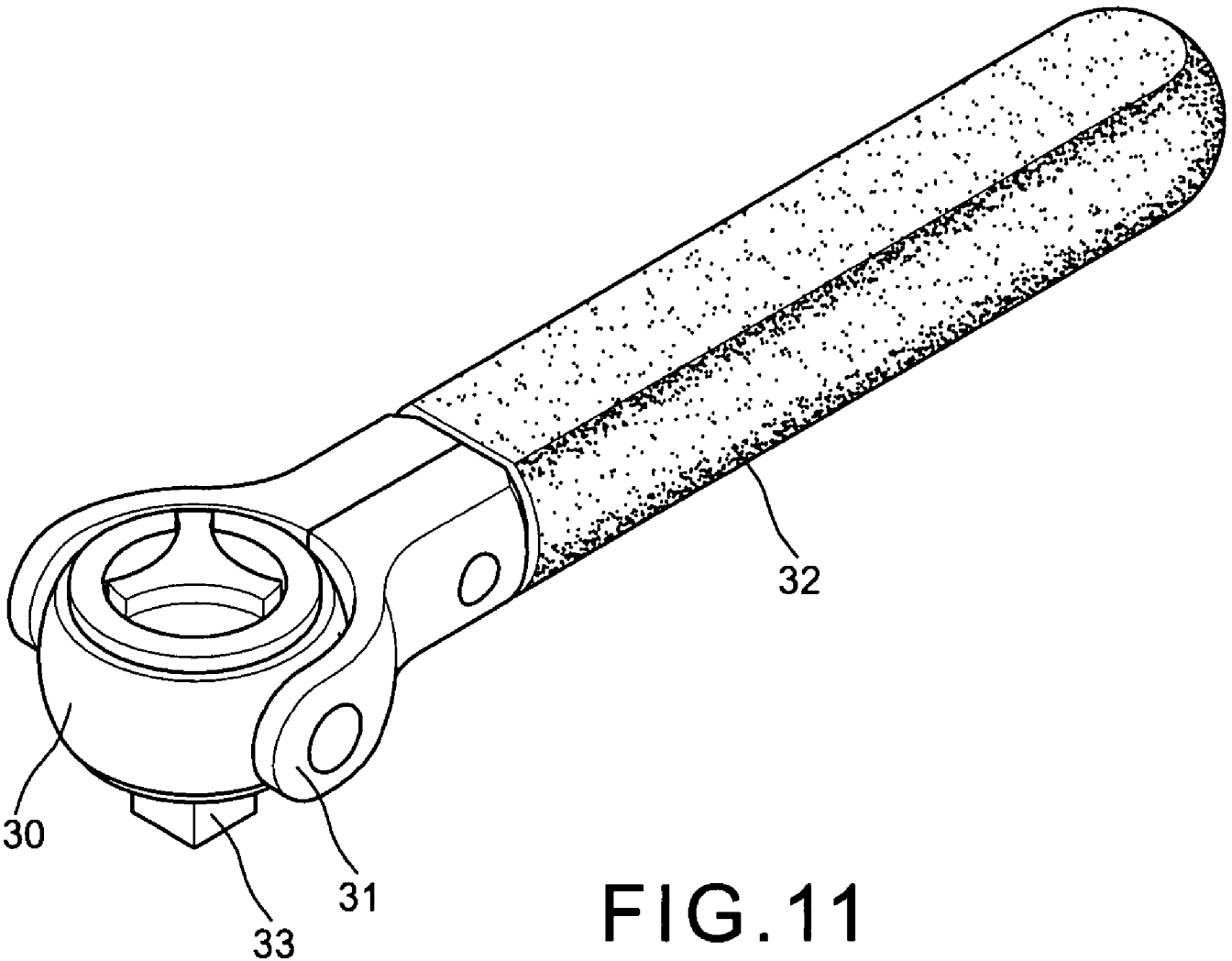
FIG. 11 Prior Art
FIG. 11 is a perspective view of a ratchet head wrench according to a prior art.

FIG. 10 shows an alternate embodiment of the wrench of the present invention. This embodiment is mostly similar to the above embodiment as described in FIGS. 1 to 9 and the above instances are mostly applicable. The only changes are that the tang 11 is entirely separated into a pair of symmetrical parts and redesignated as 11', therefore the longitudinal slit 112 is elongated to the inner end of the tang 11' and redesignated as 112'. The two symmetrical parts of the tang 11' are still connected by the screw 124 through the screw holes 123.

Further, the ratchet head 13 of the present invention not only rotates a desired angle as does by the prior art, but also rotate 360° and the ratchet head 13 has a pair of drivers 14 and 15 are progressive than the prior art which has only one driver.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A wrench having a ratchet head able to vertically and horizontally rotate for 360° comprising:

a tang having a centrally located longitudinal slit of predetermined length, at least a pair of retaining grooves spacedly formed in an underside of said tang, a pair of symmetrical arcuate prongs at a front end of said tang, said prongs each having an axial hole adjacent a free end thereof, an indentation in an inner side of said prongs communicating with said longitudinal slit and a screw hole adjacent a rear end of said prongs engaged with a screw, a drum-shaped ratchet head having a pair of axial rods centrally formed on opposing outer peripheries respectively and rotatably engaged within the axial holes of said prongs, a solid rectangular driver centrally formed on an underside of said head and a box driver centrally formed on a top of said head including a hexagonal central bore and a peripheral through hole for movably disposing therein a steel ball which is wrapped by a C-shaped elastic plate, a handle slidably sleeved on said tang and having a small upper through hole in a top for movably disposing a press button which has inner threads, a large through hole in an underside of said handle facing said small upper through hole, a bolt inserted through said large lower through hole and the longitudinal slit of said tang and having outer threads on an upper end thereof engaged with the inner threads of said press button and a stop head at a lower end thereof engageable with one of the retaining grooves of said tang, a positioning cap fixed into said large lower through hole and a spring means biased between said stop head and said positioning cap.

2. The wrench as recited in claim 1, wherein said positioning cap is screwed into said large lower through hole.

3. The wrench as recited in claim 1, wherein said drum-shaped ratchet head is vertically rotated on said prongs for 360°.

4. The wrench as recited in claim 1, wherein said ratchet is horizontally rotate rotatable for 360° in both lateral directions.

5. The wrench as recited in claim 1, wherein said box driver is magnetic.

6. A wrench having a ratchet head able to vertically and horizontally rotate for 360° comprising:

a long tang which is formed by a pair of symmetrical parts to form a longitudinal slit therebetween and said parts connected by a screw through a screw hole in a front portion thereof, at least a pair of retaining grooves spacedly formed in an under side of said tang and a pair of symmetrical arcuate prongs at a front end thereof each of which has an axial hole adjacent a free end thereof and an indentation in an inner side of said prongs communicating with said longitudinal slit, a drum-shaped ratchet head having a pair of axial rods centrally formed on opposing outer peripheries respectively and rotatably engaged within the axial holes of said prongs, a solid rectangular driver and a box driver respectively formed on opposite centers of flat portions of said head, wherein said box driver including a hexagonal central bore and a peripheral through hole for movably disposing a steel ball which is wrapped by a C-shaped elastic plate, a handle slidably sleeved on said tang and having a small upper through hole in a top for movably disposing a press button which has inner threads, a large lower through hole in an underside of said handle facing said small upper through hole, a bolt inserted through said large lower through hole, said bolt having an outer thread on an upper end engaged with the inner threads of said press button and a stop head at lower end engageable with one of said retaining grooves of said tang, a positioning cap fixed into said large lower through hole and a spring means biased between said stop head and said positioning cap.

* * * * *